US009373337B2

(12) United States Patent
Chubarev et al.

(10) Patent No.: US 9,373,337 B2
(45) Date of Patent: Jun. 21, 2016

(54) RECONSTRUCTION OF A HIGH-FREQUENCY RANGE IN LOW-BITRATE AUDIO CODING USING PREDICTIVE PATTERN ANALYSIS

(71) Applicant: DTS, INC., Calabasas, CA (US)

(72) Inventors: Pavel Chubarev, Woodland Hills, CA (US); Dmitry Shmunk, Novosibirsk (RU)

(73) Assignee: DTS, INC., Calabasas, CA (US)

( * ) Notice: Subject to any disclaimer, the term of this patent is extended or adjusted under 35 U.S.C. 154(b) by 157 days.

(21) Appl. No.: 14/084,479

(22) Filed: Nov. 19, 2013

(65) Prior Publication Data

US 2014/0142959 A1 May 22, 2014

Related U.S. Application Data

(60) Provisional application No. 61/728,526, filed on Nov. 20, 2012.

(51) Int. Cl.

| | |
|---|---|
| ***G10L 19/06*** | (2013.01) |
| ***G10L 19/02*** | (2013.01) |
| ***G10L 19/00*** | (2013.01) |
| ***G10L 19/04*** | (2013.01) |
| ***G10L 21/038*** | (2013.01) |

(52) U.S. Cl.

CPC ..... *G10L 19/0204* (2013.01); *G10L 19/00* (2013.01); *G10L 19/04* (2013.01); *G10L 19/06* (2013.01); *G10L 21/038* (2013.01)

(58) Field of Classification Search

None

See application file for complete search history.

(56) References Cited

U.S. PATENT DOCUMENTS

| | | | | |
|---|---|---|---|---|
| 7,146,324 | B2 * | 12/2006 | Den Brinker | G10L 19/02 704/500 |
| 7,756,715 | B2 * | 7/2010 | Kim | G10L 19/0204 704/216 |
| 2005/0080621 | A1 * | 4/2005 | Tsushima | G10L 21/038 704/229 |
| 2007/0063877 | A1 * | 3/2007 | Shmunk | G10L 19/0204 341/50 |
| 2007/0174063 | A1 * | 7/2007 | Mehrotra | G10L 21/038 704/501 |
| 2009/0024399 | A1 * | 1/2009 | Gartner | G10L 21/038 704/500 |

(Continued)

OTHER PUBLICATIONS

Webpage on normalized cross correlation http://web.archive.org/web/20100702225734/http://www.ocean.washington.edu/courses/ess522/lectures/08_xcorr.pdf Jul. 2, 2010 archived version.*

(Continued)

*Primary Examiner* — Pierre-Louis Desir
*Assistant Examiner* — Yi-Sheng Wang
(74) *Attorney, Agent, or Firm* — Craig S. Fischer

(57) ABSTRACT

A predictive pattern high-frequency reconstruction system and method that finds patterns in high-frequency components of an audio signal, encodes the audio signal into an encoded bitstream along with pattern information, and then uses the patterns to reconstruct the high-frequency components during decoding. The high-frequency components can be reconstructed using the pattern information alone. Embodiments of the system and method map normalized subband signals of the audio signal to a scaled representation of a time-frequency grid containing multiple tiles and perform statistical analysis on each tile to estimate subband parameters and determine whether a pattern exists. If a pattern does exist, it can be encoded in the encoded bitstream, transmitted, and used to reconstruct the high-frequency components at the decoder. A direct search technique and a fast Fourier transform (FFT) technique may be used to perform the statistical analysis.

28 Claims, 6 Drawing Sheets

(56) References Cited

U.S. PATENT DOCUMENTS

2012/0173247 A1* 7/2012 Sung ..... G10L 19/04 704/500
2014/0149124 A1* 5/2014 Choo ..... G10L 21/038 704/500

OTHER PUBLICATIONS

Herley et al "Tilings of the Time-Frequency Plane: Construction of Arbitrary Orthogonal Bases and Fast Tiling Algorithm", IEEE Trans. Signal Process vol. 41, No. 12, Dec. 1993.*

Mallat et al, "Matching Pursuits with Time-Frequency Dictionaries", IEEE Trans. Signal Processing, vol. 41, No. 12, Dec. 1993.*

International Search Report and Written Opinion for International Application No. PCT/US13/70840, mailed May 12, 2014, 16 pages.

International Preliminary Report on Patentability issued in the corresponding International Application No. PCT/US13/70840, mailed Nov. 17, 2014, 11 pages.

* cited by examiner

RECONSTRUCTION OF A HIGH-FREQUENCY RANGE IN LOW-BITRATE AUDIO CODING USING PREDICTIVE PATTERN ANALYSIS

CROSS-REFERENCE TO RELATED APPLICATION

This application claims the benefit of U.S. Provisional Patent Application Ser. No. 61/728,526 filed Nov. 20, 2012, titled "RECONSTRUCTION OF A HIGH FREQUENCY RANGE IN LOW BIT-RATE AUDIO CODING USING PREDICTIVE PATTERN ANALYSIS", to inventors Chubarev et al., the entire contents of which is hereby incorporated herein by reference.

BACKGROUND

Currently there is an absence of an efficient coding scheme for the high-frequency range within low bit-rate audio signals. Specifically, in existing audio coding schemes, such as MPEG-4 advanced audio coding (AAC), a full-band audio signal is encoded using a quantizing and coding method. However, when bandwidth is limited and a low bit-rate audio coding scheme is used, then it is sub-band audio signals that generally are encoded because of the dearth of available bits. As a result, the high frequency (HF) subbands (or components) of the audio signal often are encoded with fewer bits or completely removed to satisfy bit constraints. This lack of bits due to a reduced available bandwidth typically reduces the quality of the encoded audio signal.

The HF component of the audio signal may be encoded by detecting an envelope of a spectrum rather than a fine structure of the signal. Accordingly, in the MPEG-4 advanced audio coding (AAC) algorithm, an HF component having a strong noise component is encoded using a perceptual noise substitution (PNS) tool. For PNS encoding, an encoder detects an envelope of noise from the HF component and a decoder inserts random noise into the HF component and restores the high frequency component.

The HF component including stationary random noise can be efficiently encoded using the PNS tool. However, if the HF component includes transient noise and is encoded by the PNS tool, then a metallic noise or buzzing noise occurs. The MPEG-4 high efficiency (HE) AAC algorithm attempts to solve this problem by encoding the HF component using a spectral band replication (SBR) tool. Spectral band replication (SBR) enhances audio or speech codecs (especially at low bit-rates) based on harmonic redundancy in the frequency domain. It also can be combined with any audio compression codec. The codec itself transmits the lower and mid-frequencies of the spectrum, while SBR replicates higher frequency content by transposing up harmonics from the lower and mid-frequencies at the decoder.

Some guidance information for reconstruction of the high-frequency spectral envelope is transmitted as side information. Noise-like information is adaptively mixed in selected frequency bands in order to faithfully replicate signals that originally contained none or less tonal components. The SBR technique is based on the principle that the psychoacoustic part of the human brain tends to analyze higher frequencies with less accuracy. Thus, harmonic phenomena associated with the spectral band replication process needs only be accurate in a perceptual sense and not technically or mathematically exact.

Because the SBR technique uses a quadrature mirror filter (QMF), then a modified discrete cosine transform (MDCT) output is subjected to the QMF in order to obtain the HF component. However, this process is computationally complex and requires sufficient processing power. Similarly, the low-frequency component of a specific band is replicated and is encoded to match the original high-frequency signal using envelope/noise floor/time-frequency grid. However, this also requires additional information, such as the envelope/noise and floor/time-frequency grid, and requires bit rates of several kbps (kilobits per second) and a large amount of calculation and processing power.

In certain low bit-rate bitstreams, masking effects are high while the human auditory system frequency resolution is low. Therefore, it is not necessary to represent the signal with high precision. Despite this, existing coding methods store information with irrelevant precision. This leads to inefficient compression. Certain SBR schemes attempt to cover this need, such as U.S. Pat. No. 7,283,955.

However, such methods lack the ability to represent the HF signal content when no similar content is available in the low-frequency part. In particular, deviations in the frequency of tonal components are translated and not scaled. This results in the inability (or poor quality) to reproduce some types of audio signals (such as voice content with vibrato). Additional complex-valued filter banks are inserted in the data flow resulting in higher computational requirements. Such methods, systems, and processes are not efficient when deployed in computationally-sensitive devices.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

This document describe systems, apparatuses, techniques, and methods for encoding and decoding audio signals, and more particularly audio signals transmitted at low bandwidth. In particular, described herein is a predictive pattern high-frequency reconstruction system and method that uses predictive patterns in the high-frequency portion of the audio signal to determine whether the high-frequency components may be reconstructed by a decoder. If patterns are present and the bandwidth is low, this reconstruction of the high-frequency components can occur using the pattern information alone without having to pass the actual HF components through the bitstream. In other words, in some low-bandwidth situations the actual high-frequency components may not fit in the bitstream. Embodiments of the system and method make it possible to pass just the pattern information (or sub-band parameters) through the bitstream to the decoder so that the decoder can still reconstruct the high-frequency components of the audio signal.

Computationally speaking, embodiments of the system and method have a fairly low complexity as compared to many other types of available encoding tools. As discussed in detail below, the system and method use relatively low-complexity statistical analysis methods to determine whether a pattern exist in the high-frequency components of the audio signal. Moreover, embodiments of the system and method allow the high-frequency components to be represented with only as much frequency resolution as necessary, thereby increasing compression efficiency avoid the situations where irrelevant information is transmitted in the bitstream.

Embodiments of the system and method also are able to represent the HF components in situations where no similar content is available in the low-frequency components. This facilitates the scaling (rather than the translating) of frequency deviations in frequency components. The result is that the system and method can faithfully reproduce signals that may be difficult for other types of encoding tools to reproduce accurately.

Embodiments of the predictive pattern high-frequency reconstruction system and method process an audio signal by filtering it into time-domain samples and determining the low-frequency and high-frequency components of the signal. In some embodiments the low-frequency components are defined as those frequencies less than 6 kHz while the high-frequency components are defined as frequencies equal to or greater than 6 kHz. The audio signal then is converted into the frequency domain and filtered by a filter bank into a plurality of subbands. Moreover, the subbands are decimated to a fewer number of samples per second. The system and method then normalize the decimated subband signals.

The normalized subband signals are converted or mapped to a scaled representation of a time-frequency grid containing multiple tiles. Each tile contains multiple subbands and larger tiles represent higher frequencies and smaller tiles represent lower frequencies. Statistical analysis is performed on each tile to compute (or estimate) various subband parameters. Moreover, a statistical analysis of the subband parameters determines whether a pattern exists in the high-frequency components. If a pattern does exist, it can be encoded in the encoded bitstream, transmitted, and used to reconstruct the high-frequency components at the decoder.

A variety of statistical analysis techniques may be used, including a direct search technique and a fast Fourier transform (FFT) technique. The direct search technique involves comparing each tile of the time-frequency grid with a library of patterns to determine whether a pattern exists. The direct search technique searches all possible values for some of the subband parameters and then performs either a cross-correlation analysis or a minimum difference analysis of synthesized sinusoids with the audio signal to find additional subband parameters.

The cross-correlation and minimum difference approaches both can be used to determine a signal-to-noise (SNR) threshold. The SNR threshold may either be fixed or vary based on a base frequency of each tile. Either estimation approach may be used to determine an optimal mix of a synthesized pattern and white noise for reconstruction of the high-frequency components by the decoder. The optimal mix may be determined by using weighting values to weight the synthesized pattern and the white noise.

The FFT technique uses an FFT on each individual subband to estimate the subband parameters. The FFT technique computes an N-point FFT for each subband of a tile and then takes the absolute value to compute amplitude spectras. The amplitude spectras are combined into a single combined amplitude spectrum by stacking them one after the other. Next, the FFT technique computes an autocorrelation using the combined amplitude spectrum as the input vector. The peaks of the autocorrelation are candidate values for one of the subband parameters. These candidate values are used to find another subband parameter. Once these two subband parameters are found, then a third subband parameter is computed as a difference between deviations in a first half of spectrums neighboring sinusoid frequencies.

In some embodiments the presence of a pattern is detected but no specific subband parameters are found. In this situation, instead of the subband parameters a measured autocorrelation is placed in the encoded bitstream. At the decoder a pattern is synthesized using some fixed subband parameters to create a synthesized fixed pattern. This synthesized fixed pattern is mixed with white noise at some mix ratio. The mix ration is proportional to the measured autocorrelation.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

DETAILED DESCRIPTION

In the following description of embodiments of a predictive pattern high-frequency reconstruction system and method reference is made to the accompanying drawings, which form a part thereof, and in which is shown by way of illustration a specific example whereby embodiments of the predictive pattern high-frequency reconstruction system and method may be practiced. It is to be understood that other embodiments may be utilized and structural changes may be made without departing from the scope of the claimed subject matter. Moreover in some instances, well-known circuits, structures, and techniques have not been shown in order not to obscure the understanding of this description.

I. Predictive Pattern High-Frequency Reconstruction System

Embodiments of the predictive pattern high-frequency reconstruction system and method determines the high-frequency (HF) components of an audio signal and analyzes these HF components to determine whether a pattern exists. If patterns do exist, then the subband parameters for these HF components are encoded into a bitstream first followed by the actual HF components. In situations where there is only enough bandwidth to send the subband parameters, a decoder is still able to reconstruct the HF components using just the subband parameters.

Figure 1:
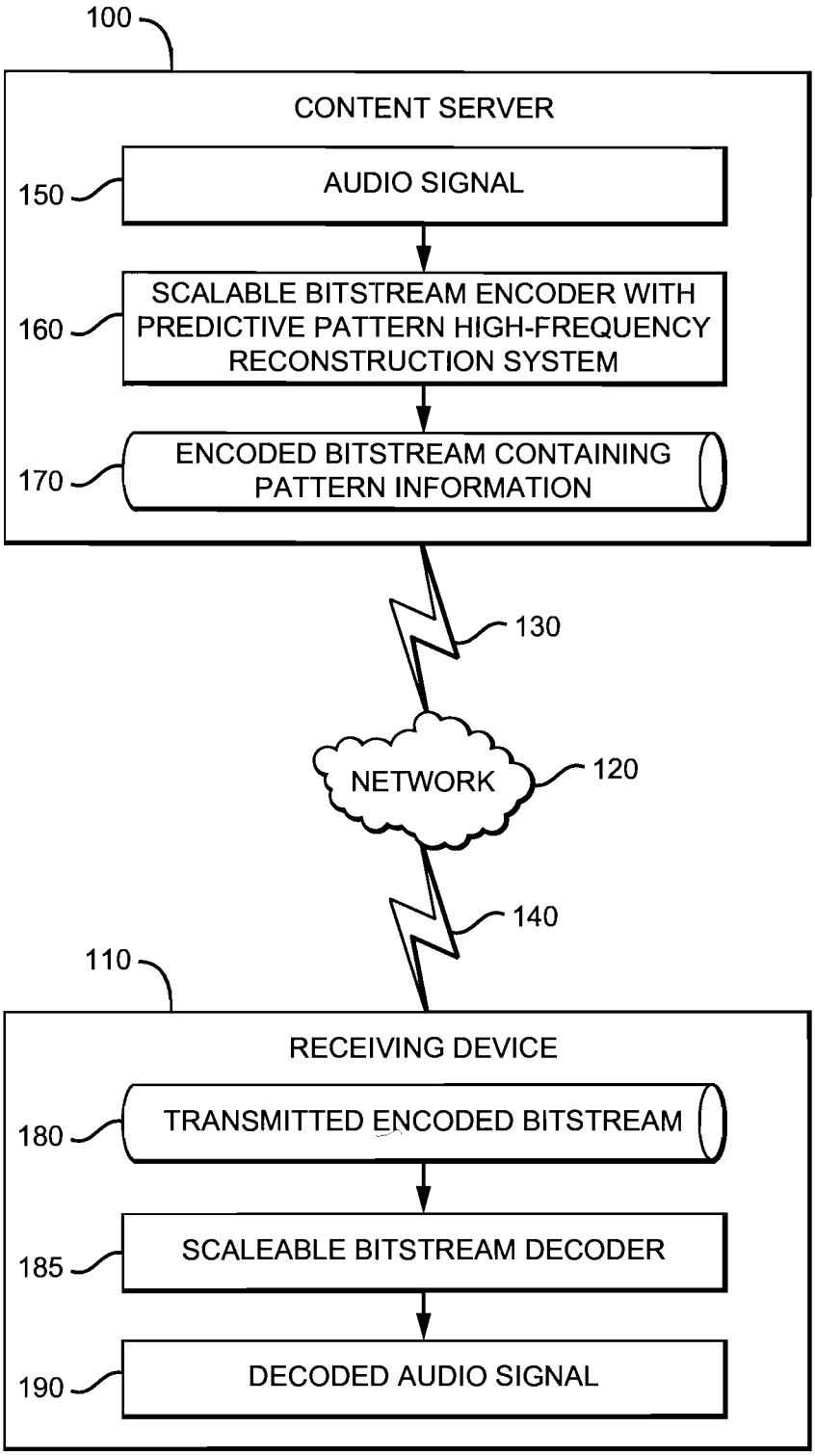
FIG. 1 is a block diagram illustrating a general overview of environments in which embodiments of the predictive pattern high-frequency reconstruction system and method may be used.

FIG. 1 is a block diagram illustrating a general overview of environments in which embodiments of the predictive pattern high-frequency reconstruction system and method may be used. As shown in FIG. 1, a content server 100 is in communication with a receiving device 110 over a network 120. The content server 100 communicates with the network 120 using a first communications link 130. Similarly, the receiving device 110 communicates with the network 120 using a second communication link 140.

The content server 100 contains an audio signal 150 that is input to a scalable bitstream encoder 160. The audio signal 150 can contain various types of content in a variety of forms and types. Moreover, the audio signal 150 may be in an analog, digital or other form. Its type may be a signal that occurs in repetitive discrete amounts, in a continuous stream, or some other type. The content of the audio signal 150 may be virtually any type of audio data.

The scalable bitstream encoder creates a unique compressed bitstream containing a structure and format that allow the bitstream to be altered without first decoding the bitstream into its uncompressed form and then re-encoding the resulting uncompressed data at a different bitrate. This bitrate alteration, known as "scaling", maintains optimal quality while requiring low computational complexity.

Moreover, the scalable bitstream encoder 160 provides for bitrate scaling in small increments. This is achieved in part by dividing the data into data chunks, such that each data chunk contains multiple bytes of data. Both the data chunks and the bits in the data chunk are ordered in order of psychoacoustic importance. Depending on the available bandwidth, the data chunks are transmitted until the bandwidth constraint is reached at which time the remainder of the data chunks are not transmitted. Because the data chunks are ordered in psychoacoustic importance the most important data is transmitted first thereby ensuring quality decoding of the audio signal 150. The scalable bitstream encoded 160 is disclosed in U.S. Pat. Nos. 7,333,929 and 7,548,853, the entire contents of which are hereby incorporated by reference.

Embodiments of the predictive pattern high-frequency reconstruction system and method are contained in the scalable bitstream encoder 160. The system and method detect predictable patterns in the HF components of the audio signal 150 and extract this pattern information for encoding in an encoded bitstream containing pattern information 170. This encoded bitstream 170 is transmitted over the network 120 from the content server 100 to the receiving device 110.

The receiving device 110 receives the transmitted encoded bitstream 180 and decodes it using a scalable bitstream decoder 185. The decoder 185 obtains the pattern information from the transmitted encoded bitstream 180 and from the pattern information reconstructs the HF components of the audio signal. The output of the decoder 185 is a decoded audio signal 190, which is a representation of the original audio signal 150.

Figure 2:
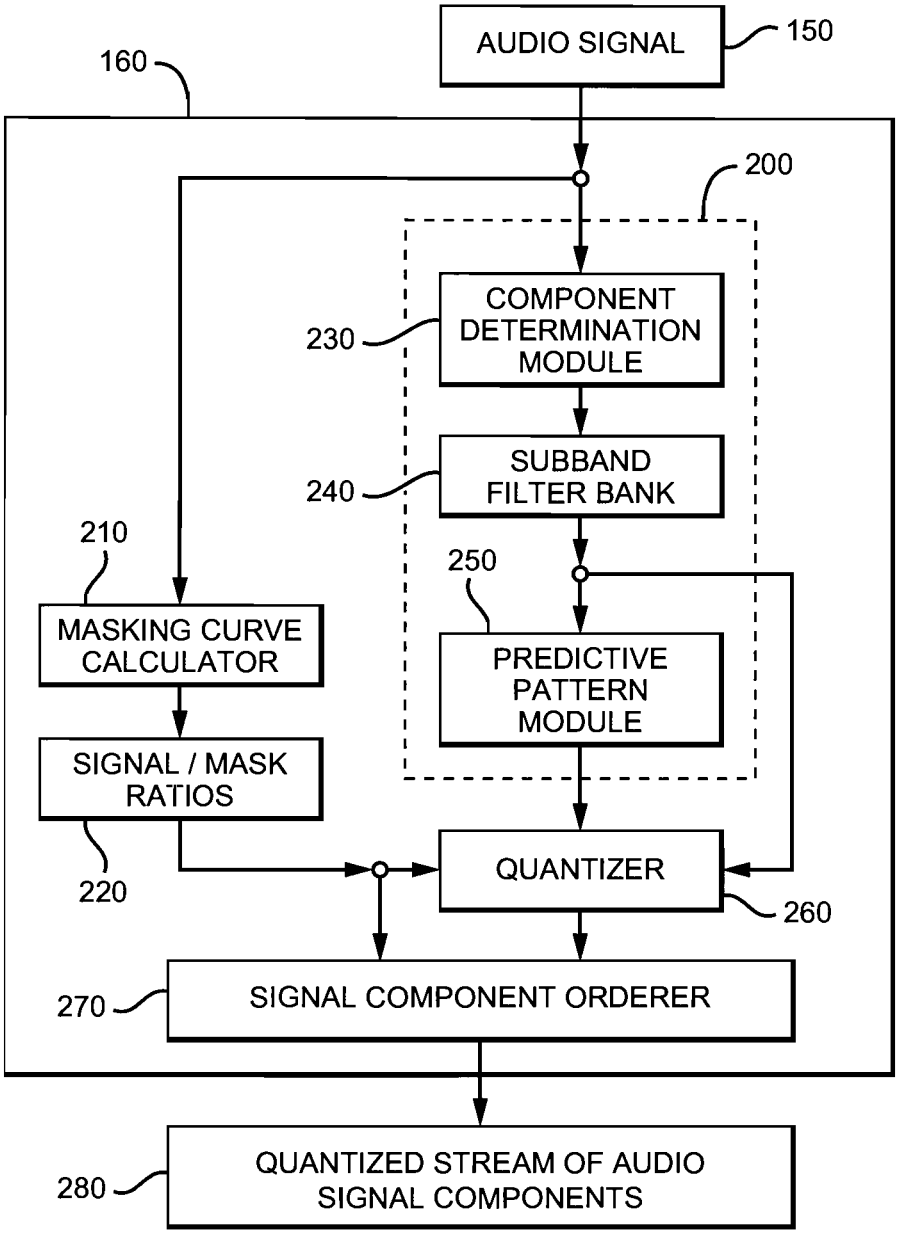
FIG. 2 is a block diagram illustrating a more detailed view of embodiments of the predictive pattern high-frequency reconstruction system and method implemented in the scalable bitstream encoder shown in FIG. 1.

FIG. 2 is a block diagram illustrating a more detailed view of embodiments of the predictive pattern high-frequency reconstruction system 200 and method implemented in the scalable bitstream encoder 160 shown in FIG. 1. Specifically, the audio signal 150 is input to the scalable bitstream encoder 160. The audio signal 150 is processed by a masking curve calculator 210 and the system 200, which is shown in FIG. 2 by the dotted line.

The masking curve calculator 210 dynamically computes a masking curve (not shown) for each data frame of the audio signal 150. The masking curve is computed from known response characteristics of the human ear and the frequency distribution of the audio signal 150 during the data frame. The shape of the masking curve represents the relative insensitivity of the human ear to the very low and to the high frequency ranges. The output of the masking curve calculator 210 is a series of signal-to-mask (signal/mask) ratios 220. In some embodiments, signal/mask ratios 220 are a series of ratios of the magnitudes of the audio signal 150 in each of the frequency bands to the calculated masking level in those bands.

Embodiments of the system 200 include a number of submodules, including a component determination module 230, a subband filter bank 240, and a predictive pattern module 250. The component determination module 230 processes the audio signal 150 to determine its low-frequency (LF) and high-frequency (HF) components. In some embodiments of the system 200 and method the HF components of the audio signal are defined as generally greater than or equal to 6 kHz.

The LF and HF components are passed through the subband filter bank 240 to separate them into subband signals. These subband signals are processed by the predictive pattern module 250 to determine whether a pattern is present in the subbands of the HF components. If so, then subband parameters of the HF components are included in the encoded bitstream 170. In addition, the individual frequency band magnitude values from the subband filter bank 240 are sent to a quantizer 260 to be quantized in accordance with the signal/mask ratios 220 calculated by the masking curve calculator 210. These quantized values are the output of the quantizer 260.

A signal component orderer 270 takes the quantized frequency band magnitudes and places them in an order of their importance to the audio signal as perceivable by the human ear. This is done in accordance with the signal/mask ratios 220. The output of the signal component orderer 270 contains the full quantized magnitudes of these frequency bands but arranged in an order in time according to their importance to the signal as perceived by the human ear. The order of these components is that of their signal/mask ratios 220. The component with the highest ratio is place first in the order and the component with the lowest ratio is place last in the order. The output of the scalable bitstream encoder 160 is a quantized stream of audio signal components 280.

Figure 3:
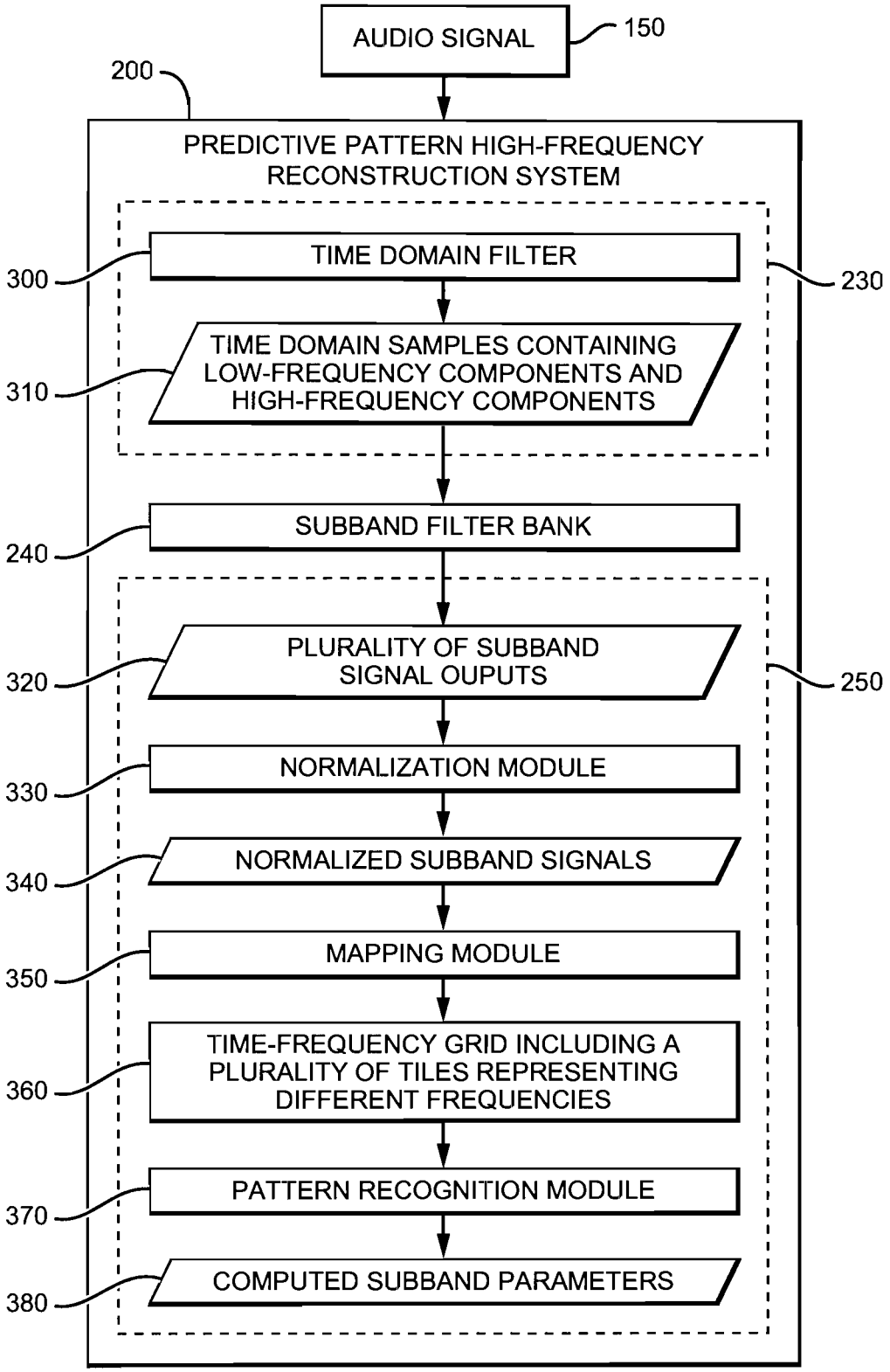
FIG. 3 is a block diagram illustrating details of sub-modules of embodiments of the predictive pattern high-frequency reconstruction system and method shown in FIG. 2.

FIG. 3 is a block diagram illustrating details of sub-modules of embodiments of the predictive pattern high-frequency reconstruction system 200 and method shown in FIG. 2. As shown in FIG. 3, the audio signal 150 is input to the system 200. The component determination module 230 includes a time domain filter 300 that processes the audio signal 150. The results of this processing are time domain samples 310 that contain both LF components and HF components.

The time domain samples 310 are output to the subband filter bank 240. The audio signal is converted to the frequency domain and the subband filter bank 240 filters the audio signal into multiple subbands. These plurality of subband signal outputs 320 are output from the subband filter bank 240 and input for the predictive pattern module 250.

The predictive pattern module 250 includes a normalization module 330 that normalizes the subband signal outputs 320 and to produce normalized subband signals 340. These normalized subband signals 340 are sent to a mapping module 350. The mapping module 350 maps the normalized subband signals 340 to a time-frequency grid 360 that includes multiple tiles. These multiple tiles represent different frequencies. A pattern recognition module 370 performs statistical analysis on the tiles to determine whether patterns present themselves. If so, then the pattern recognition module 370 computes subband parameters for the HF components. The computed subband parameters 380 are output from the system 200.

II. Operational Overview

Figure 4:
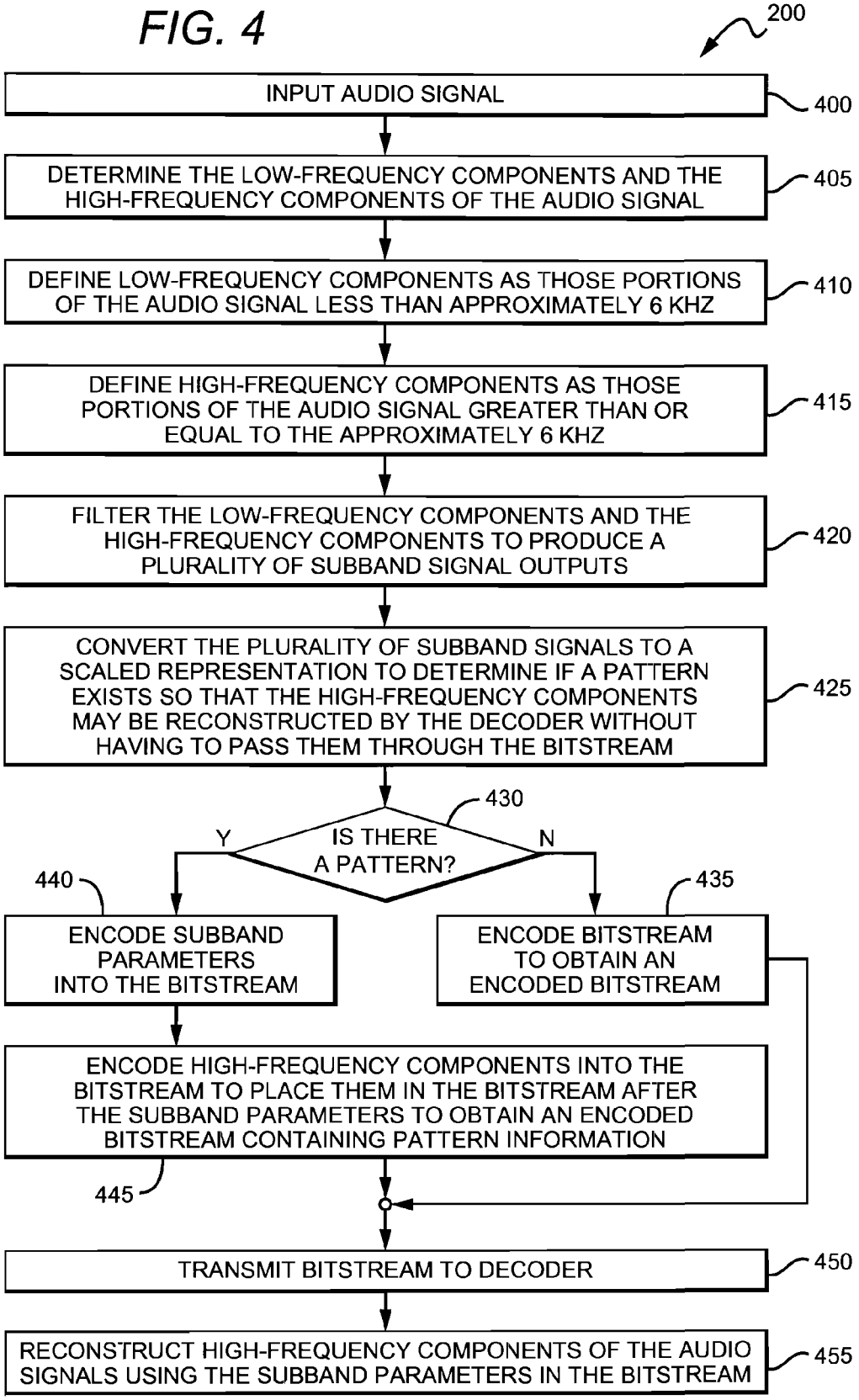
FIG. 4 is a flow diagram illustrating the general operation of embodiments of the predictive pattern high-frequency reconstruction system and method shown in FIGS. 2 and 3.

FIG. 4 is a flow diagram illustrating the general operation of embodiments of the predictive pattern high-frequency reconstruction system 200 and method shown in FIGS. 2 and 3. The operation begins by inputting an audio signal (box 400). Next, the component determination module 230 determines the low-frequency components and the high-frequency components of the audio signal (box 405). In some embodiments the LF components are defined as those frequencies of the audio signal that are less than approximately 6 kHz (box 410). Moreover, in some embodiments the HF components are defined as those frequencies of the audio signal that are greater than or equal to approximately 6 kHz (box 415).

Next, the subband filter bank 240 filters the LF components and the HF components to produce a plurality of subband signal outputs (box 420). The predictive pattern module 250 converts the plurality of subband signal outputs 320 to a scaled representation to determine if a pattern exists (box 425). This is done to determine whether the HF components may be reconstructed by the decoder without it being necessary to pass the actual HF components through the bitstream. In other words, in some low-bandwidth situations the actual HF components may not fit in the bitstream and it is desirable that the decoder still be able to reconstruct the HF components of the audio signal 150.

The predictive pattern module 250 then determines whether a pattern is present in the HF components (box 430). As explained in detail below, this is performed using a statistical analysis method. If no pattern exists, then the HF components are encoded in the bitstream to obtain an encoded bitstream (box 435). If patterns are found, then the pattern information in the form of the subband parameters associated with the HF components are encoded into the encoded bitstream (box 440).

In addition to the subband parameters, the HF components are also encoded into the encoded bitstream (box 445). The encoding occurs in an ordered manner, such that the subband parameters are placed first in the bitstream and the HF components are placed after the subband parameters. This produces an encoded bitstream containing ordered pattern information and HF components.

The encoded bitstream can be transmitted to a decoder (box 450), such as to the scalable bitstream decoder 185 shown in FIG. 1. Depending on the available bandwidth of the channel over which the transmission occurs, all of the pattern information and HF components may or may not be transmitted. For example, if the bandwidth is small, then the encoded bitstream may only include all or some of the pattern information. If the bandwidth is large, then the encoded bitstream may include some or all of the HF components and the pattern information. The decoder uses the pattern information (and the HF components if available) to reconstruct the HF components of the audio signal (box 455).

III. Operational Details

The operational details of embodiments of the predictive pattern high-frequency reconstruction system 200 and method will now be discussed. Embodiments of the system 200 and method generally are designed to work with a scalable bitstream encoder.

Elements of embodiments of the predictive pattern high-frequency reconstruction system 200 and method may be implemented by hardware, firmware, software or any combination thereof. When implemented in software, the elements of an embodiment of the system 200 and method are essentially the code segments to perform the necessary tasks. The software may include the actual code to carry out the operations described in embodiment of the system 200 and method, or code that emulates or simulates the operations.

The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium that can store, transmit, or transfer information. Examples of the processor readable medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

The machine accessible medium may be embodied in an article of manufacture. The machine accessible medium may include data that, when accessed by a machine, cause the machine to perform the operation described in the following. The term "data" here refers to any type of information that is encoded for machine-readable purposes. Therefore, it may include program, code, data, file, etc.

All or part of embodiments of the system 200 and method may be implemented by software. The software may have several modules coupled to one another. A software module is coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device.

Embodiments of the system 200 and method may be described as a process which is sometimes depicted as a flowchart, a flow diagram, a structure diagram, or a block diagram. Although a block diagram may describe the operations as a sequential process, many of the operations can be performed in parallel or concurrently. In addition, the order of the operations may be rearranged. A process is terminated when its operations are completed. A process may correspond to a method, a program, a procedure, and so forth.

Embodiments of the system 200 and method will be described in the context of a codec that organizes audio samples to some degree both in frequency and in time. More particularly, the description below illustrates by example the use of a codec that uses digital filter banks to separate an audio signal into a plurality of subband signals and maps the subband signals on a time frequency grid to determine if a pattern exists. In this manner the high-frequency range of the audio signal.

It should be noted that embodiments of the system 200 and method are not limited to such a context. Rather, the techniques are also pertinent to any "transform codec," which may for this purpose be considered a generic case of a subband codec. Specifically, a subband codec of the type that uses a mathematical transform to organize a temporal series of samples into a frequency domain representation. Thus, by way of example and not limitation, the techniques described below may be adapted to a discrete cosine transform codec, a modified discrete cosine transform codec, Fourier transform codecs, wavelet transform codecs, or any other transform codecs. In the realm of time-domain oriented codecs, the techniques may be applied to sub-band codecs that use digital filtering to separate a signal into critically sampled subband signals (for example, DTS 5.1 surround sound as described in U.S. Pat. No. 5,974,380 and elsewhere).

It should be understood that embodiments of the system 200 and method have both encode and decode aspects. In general, these aspects will function in a transmission system: an encoder, transmission channel, and complementary decoder. The transmission channel may comprise or include a data storage medium, or may be an electronic, optical, or any other transmission channel (of which a storage medium may be considered a specific example). The transmission channel may include open or closed networks, broadcast, or any other network topology.

The encoder and decoder aspects will be described separately herein, but it should be noted that they are complementary to each other. The environment includes an encoder configured to receive at least one audio signal. The audio signal of at least one channel is provided as input. For purposes of this disclosure, it is assumed that the audio signal represents a tangible physical phenomenon. Specifically, the audio signal may be a sound that has been converted into an electronic signal, such as converted into a digital format by an analog-to-digital conversion process, and suitably pre-processed. Typically, as in known in the art, analog filtering, digital filtering, and other pre-processes are applied to minimize aliasing, saturation, or other signal processing errors.

Figure 5:
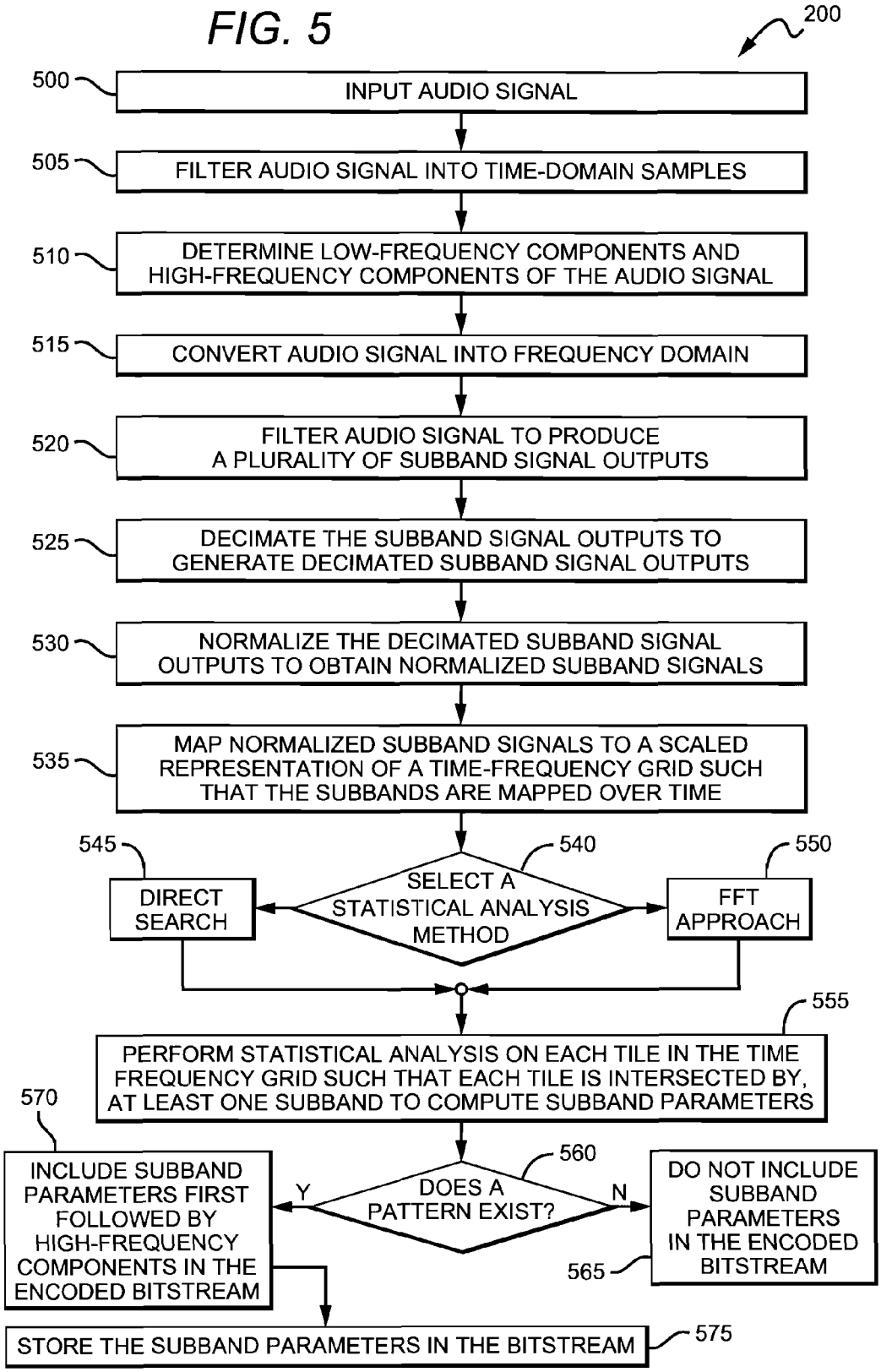
FIG. 5 is a flow diagram illustrating the detailed operation of embodiments of the predictive pattern high-frequency reconstruction system and method shown in FIGS. 1-4.

FIG. 5 is a flow diagram illustrating the detailed operation of embodiments of the predictive pattern high-frequency reconstruction system 200 and method shown in FIGS. 1-4. Referring to FIG. 5, the method begins by receiving an input audio signal (box 500). The audio signal then is filtered into time-domain samples (505). Filtering the audio signal provides a linear transformation of a number of surrounding samples around the current sample of the input audio signal. Embodiments of the method may employ conventional filtering techniques such as linear filters, causal filters, time-invariant filters, adaptive filters, a finite impulse response (FIR) filter.

The method then determines the low-frequency and the high-frequency components of the audio signal (box 510). In some embodiments of the system 200 and method the HF components of the audio signal are defined as generally greater than or equal to 6 kHz. Certain high-frequency ranges (such as those frequencies above 16 kHZ) are usually imperceptible by humans. This means that frequently these frequencies may be excluded from the encoded bitstream (such as when bitrates are low) without compromising the perceived sound quality.

A few high-frequency audio events, however, are distinguishable by the human auditory system in this HF range and should be included in the encoded bitstream. These events include:

1. Slowly-varying noise, smoothly shaped in time and frequency
2. Sharp individual attacks (known as "transients")
3. Strong individual tonal components
4. Tonal components that are part of a harmonic series, possibly with slowly varying frequencies (such as tonal fragments of voice)
5. HF components of pitched signals (closely-spaced transients)
6. Possibly, other types of signals spread in frequency and time (as in #4 and #5) with correlated phases.

Figure 6:
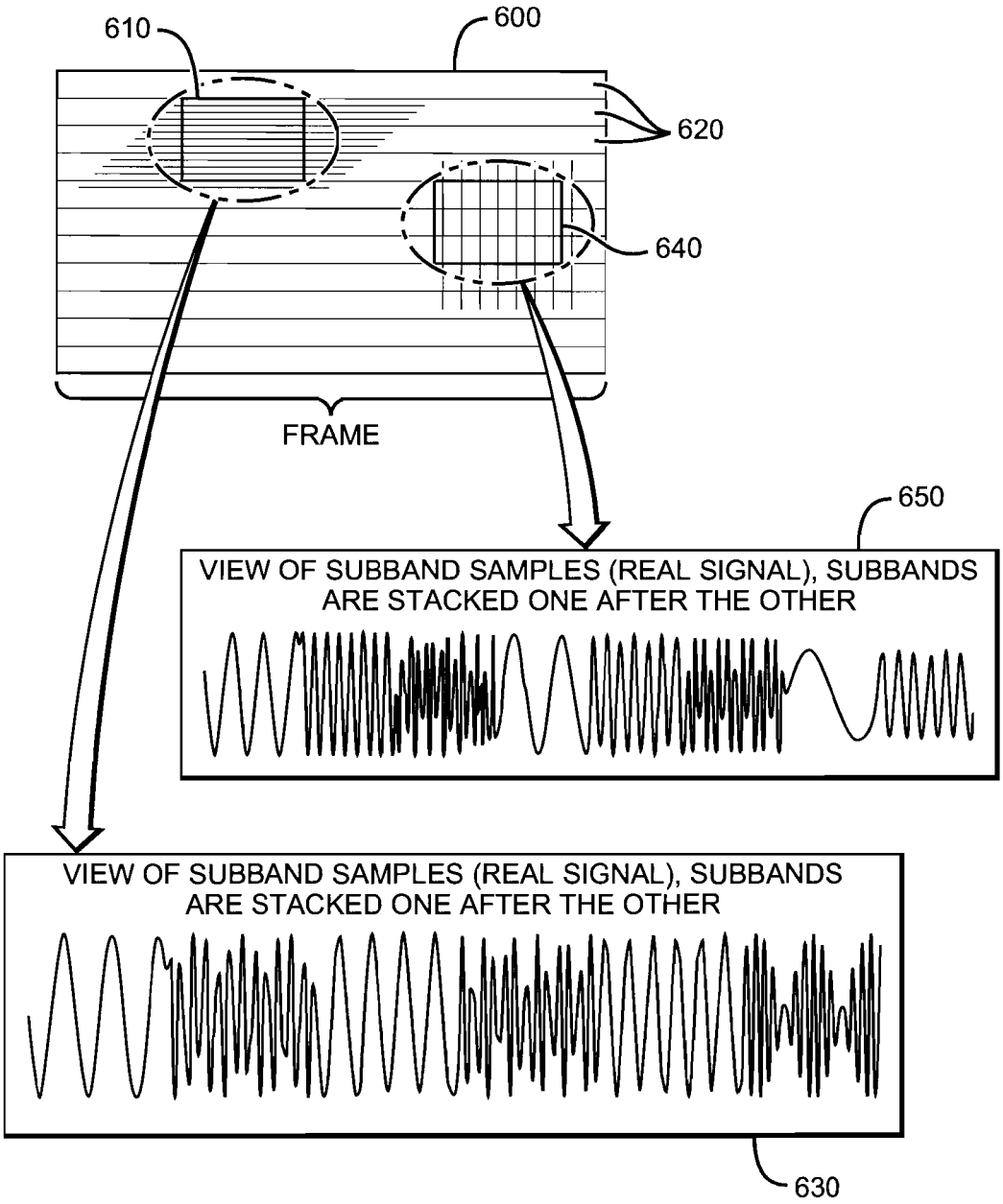
FIG. 6 illustrates the high-frequency components of tonal components that are part of a harmonic series and the high-frequency components of pitched signals.

FIG. 6 illustrates the events described in #4 and #5 above. In particular, a frame 600 of an audio signal is shown in FIG. 6. This frame 600 includes a first tile 610 containing a plurality of subbands 620 and containing the tonal components described in #4. A first expanded view 630 of the first tile 610 illustrates a view of subband samples (where the subbands are stacked one after the other) containing the tonal components that are part of a harmonic series.

Also shown in FIG. 6 is a second tile 640 containing a plurality of subbands 620 and containing the HF components of pitched signals described in #5. A second expanded view 650 of the second tile 640 illustrates a view of subband samples containing the closely-spaced transients.

High-frequency audio events other than those enumerated in #1 to #6 above may be replaced by slowly varying noise without having a perceptible difference to the human auditory system. This noise is smoothly shaped in time and frequency. Within a low bit-rate coding environment, high-frequency audio events such as #1 and #2 are efficiently represented by residual scale-factor grids. Other high frequency audio events, such as #3, are efficiently represented by tonal coding. In the subband domain, high-frequency audio events (such as #4 to #6) are seen as sinusoids of various frequencies. In some cases a number of sinusoids may be superimposed within single subband.

Referring again to FIG. 5, subsequent to determining the high-frequency and low-frequency components of the audio signal, the audio signal is converted into the frequency domain (box 515). The result then is filtered by a filter bank to produce a plurality of subband signal outputs (box 520). In some embodiments there would be a large number of subband signal outputs. By way of example and not limitation, 32 or 64 of the subband signal outputs may be output.

Moreover, as part of the filtering function, the filter bank critically decimates the subband signal outputs in each subband (box 525). In other words, the filter bank specifically decimates each subband signal output to a lesser number of samples per second. This is just sufficient to fully represent the signal in each subband, which is call "critical sampling." Critical sampling techniques are well known in the art.

After being filtered and decimated, each of the plurality of subband signal outputs (comprising sequential samples in each subband) is normalized to obtain normalized subband signals (box 530). Normalization applies a constant amount of gain to selected regions of the subbands to bring the highest peaks to a target level. The method then maps the normalized subband signals to a scaled representation of a time-frequency grid such that the patterns are mapped over time (box 535). This helps determine whether a pattern exists from which the high-frequency component may be reconstructed without having to pass it through the bitstream. Due to bit constraints, it is advantageous to avoid transmitting the high-frequency component. Thus, the normalized subband sample is mapped to a representation of a time-frequency grid, where the subbands are mapped over time.

The time-frequency grid includes a plurality of tiles representing different frequencies. Each tile represents a different frequency such that larger tiles represent higher frequencies and smaller tiles represent lower frequencies. Typically 3 to 8 subbands by 32 samples are mapped per tile. This may amount to approximately 1.5-5 kHz by 20 milliseconds. However, more or fewer subbands may be found in particular tiles and greater or less than 32 samples may be included.

Subsequent to mapping the subbands, a statistical analysis method is selected (box 540). This selection may be made manually, by a user, or automatically by embodiments of the system 200 and method. Moreover, this selection may be made at this time or may have been made previously. Either a direct search analysis (box 550) or a fast Fourier transform (FFT) analysis (550) may be selected.

A statistical analysis using the selected technique is performed on each tile in the time-frequency grid that is intersected by at least one subband to compute various subband parameters (box 555). These subband parameters generally measure sinusoids of the subbands and are estimated for each subband in each tile. The statistical analysis of the subband parameters determines whether a pattern exists for the decoder to reconstruct the high frequency portion.

These estimated subband parameters include:

F0=The frequency offset (from the bottom of the lowest subband of the first sinusoid DeltaF=The distance between the two closest sinusoids Ph(i)=The initial phase of each sinusoid. i=1 . . . N, where N is the total number of sinusoids Slant=change in frequency over the time-duration of tile. In some embodiments a linear change is assumed. A single parameter for all sinusoids in a tile.

When subband parameters are slightly different between successive tiles (particularly Ph(i)), there is a chance of getting a 'click' or noise floor increase on the boundary crossing in re-synthesis. Although such an effect is minor and may be ignored, it can be remedied by linking the differing subband parameters by performing interpolation between tiles and smoothly varying the parameter from its initial value to the value in the successive tile. Alternatively, the tiles may be partially overlapped in time with windows applied at the crossing portions.

Referring again to FIG. 5, a determination is made as to whether a pattern exists based on the statistical analysis (box 560). If not, then no subband parameters are included in the encoded bitstream (565). If so, then the subband parameters are included in the encoded bitstream (box 570). The subband parameters are ordered in the encoded bitstream such that they are first in order and are followed by the high-frequency components of the audio signal. In this manner the method stores the subband parameters in the encoded bitstream (box 575).

III.A. Direct Search Technique

In some embodiments of the predictive pattern high-frequency reconstruction system 200 and method a direct search technique is used for statistical analysis. In general, the direct search technique compares each tile with a library of patterns to determine whether patterns exist. Specifically, parameters measured in each tile are compared with parameter patterns stored in the library. The library consists of patterns of all possible combinations of possible values of parameters (F0, DeltaF, Slant). Because such a library would take a huge amount of memory, it is not kept at a whole. Instead a library-element (pattern) synthesis is performed on the fly during a comparison (cross-correlation or minimum-difference analysis) procedure. The synthesized sinusoids mentioned below refer to the individual sinusoids from which this synthesized pattern consists (namely, the sinusoids of frequencies F0; F0+DeltaF; F0+2*DeltaF; etc).

The direct search technique searches all possible values of F0 and DeltaF. The technique then performs either cross-correlation analysis or minimum difference analysis of synthesized sinusoids with the signal to find the values of Ph(i). The cross-correlation approach calculates the power of the subband samples (Pin), the power of the synthesized sinusoids (Ps) and their dot-product (Prod). A normalized cross-correlation between (Pin) and (Ps) is represented as:

$$Xn=\text{Prod}/(\text{Sqrt}(\text{Pin})*\text{Sqrt}(Ps)).$$

The cross-correlation is selected, where the cross-correlation is calculated for sinusoids rotated by a different rotation angle (defined by Ph(i)), and the Ph(i) with the maximum correlations for sinusoids are picked or selected as the values for Ph(i).

The formula to synthesize sinusoid is:

$$S(i,t)=\sin((F0+i*\text{Delta}F)*t+Ph(i))$$

i=sinusoid index (0 . . . K); K–total num of sinusoids, such that frequency (F0+K*DeltaF) is below the highest frequency covered by tile.

t=time.

Some embodiments of the system 200 and method estimate Ph(i) values uses difference minimization. The difference minimization approach calculates the power of the signal samples (Pin) and a power of a residual signal obtained by subtracting synthesized samples from signal samples (Pres). The normalized cross correlation is determined by the difference equation:

$$Xn=(\text{Pin}-\text{Pres})/\text{Pin}.$$

The cross-correlation calculated for sinusoids rotated by a different angle (defined by Ph(i)), and the Ph(i) with the minimum correlation is selected.

The cross correlation and difference minimization approaches determine the signal-to-noise (SNR) threshold. In some embodiments, the SNR threshold is fixed at 0.5 (for cross-correlation method). Thus, it is considered that the pattern is present if Xn>0.5 for cross-correlation method. However, the SNR threshold may vary depending on tile base frequency. When using a varying SNR threshold, it is advantageous to use the patterns method for reconstructing HF components of the audio signal 150. Below a certain threshold, the signal is considered pure noise and there is no need to use the reconstruction technique. Generally, audio signals transmitted at a low bitrate have some amount of noise mixed in.

Weighting values may be calculated from either estimation approach to determine the optimal mix of a synthesized "pattern" and noise. For example, the weighting for mixing on decoder side can be calculated as follows:

$$\text{MixedSample}=\text{WeightedPattern}+\text{WeightedWhiteNoise}$$

$$\text{WeightedPattern}=\text{Pattern}*(0.3+Xn*0.7$$

$$\text{WeightedWhiteNoise}=\text{WhiteNoise}*(0.9f-Xn*0.7).$$

Once the library parameters are found, they are stored in the bitstream.

III.B. Fast Fourier Transform (FFT) Technique

In some embodiments of the predictive pattern high-frequency reconstruction system 200 and method an FFT technique is used for statistical analysis. In general, subband parameters in each tile are estimated using a Fourier-transform based approach to determine whether a pattern for reconstructing the high frequency range exists. Specifically, subband parameters F0's, DeltaF's, Ph(i) are calculated for each subband individually by performing a fast Fourier transform (FFT) over its samples. A person skilled in the art will understand that subbands may be calculated using any frequency transform such as an FFT, discrete cosine or discrete sine transforms.

Subsequently, a slant is determined for each F0 and DeltaF. A global F0, DeltaF are obtained afterwards by analyzing results from all the subbands. The steps for the FFT technique are as follows:

1. Compute an N-point FFT in each subband of a tile. (The time duration is assumed for the N subband samples)
2. Take absolute value of FFT spectra (it is an amplitude spectra)
3. Combine the amplitude spectras from tile subbands into a single spectra, by stacking them one after other as follows:
   First subband spectrum goes into bins: 0 . . . N/2
   Second subband spectrum goes into bins:
   N/2+1 . . . N
4. Compute an autocorrelation using the combined amplitude spectrum from step #3 above) as the input vector
5. The positions of peaks in autocorrelation function are the candidate values of DeltaF's to be used in search of the best fitting DeltaF parameter
6. For each DeltaF candidate, estimate F0. The same may be performed by computing a cross-correlation between amplitude spectrum (as calculated in step #3, above) and an amplitude spectrum (calculated the same way as in steps 1-3) for a synthesized pattern with F0=0, same DeltaF as candidate, Slant=0. The position of cross-correlation maximum is the F0
7. Compute the Slant for the given F0 and DeltaF, as follows:
   a. Repeat steps 1-3 for the halves of the tile: samples 0 . . . N/2, and samples N/2+1 . . . N. The result is two amplitude spectras
   b. Find an averaged energy deviation in the regions of halves spectrums neighboring the sinusoid frequencies (F0+i*DeltaF)
   c. Compute the Slant as the difference between deviations in first half and second half. For example, if freq. deviates up in $1^{st}$ half and down in $2^{nd}$ half, then the Slant is negative; if deviation is the same in both halves, then the Slant is equal to 0.

In the computing the autocorrection step defined above (step 4), the FFT technique allows detection of a pattern (a regular structure) present in the signal tile even if in the later steps matching parameters (F0, DeltaF, Slant) are not found for the pattern. In this situation, when the presence of a pattern is detected but no specific parameters are found, a presence of the pattern for the signal tile may still be determined. Instead of storing pattern parameters in the bitstream, a measured autocorrelation is placed in the bitstream.

Subsequently, on the decoder side, the pattern is synthesized with some fixed F0, DeltaF, Slant parameters (say F0=0, Slant=0, DeltaF=minimal). The synthesized fixed pattern is then mixed with white noise with the mix ratio being proportional to the autocorrelation measure.

IV. Alternate Embodiments and Exemplary Operating Environment

Many other variations than those described herein will be apparent from this disclosure. For example, depending on the embodiment, certain acts, events, or functions of any of the algorithms described herein can be performed in a different sequence, can be added, merged, or left out altogether (such that not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm processes and sequences described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Embodiments of the predictive pattern high-frequency reconstruction system 200 and method described herein are operational within numerous types of general purpose or special purpose computing system environments or configurations. In general, a computing environment can include any type of computer system, including, but not limited to, a computer system based on a microprocessor, a mainframe computer, a digital signal processor, a portable computing device, a personal organizer, a device controller, and a computational engine within an appliance, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The steps of a method, process, or algorithm described in connection with the embodiments disclosed herein can be embodied directly in hardware, in a software module executed by a processor, or in a combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the predictive pattern high-frequency reconstruction system 200 and method described herein, or portions thereof, may be stored, received, transmitted, or read from any desired combination of computer or machine readable media or storage devices and communication media in the form of computer executable instructions or other data structures.

Embodiments of the predictive pattern high-frequency reconstruction system 200 and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show particulars of the present invention in more detail than is necessary for the fundamental understanding of the present invention, the description taken with the drawings making apparent to those skilled in the art how the several forms of the present invention may be embodied in practice.

What is claimed is:

1. A method performed by one or more processing devices for processing an audio signal, comprising:

filtering the low-frequency components and the high-frequency components of the audio signal to produce a plurality of subband signal outputs;

converting the plurality of subband signal outputs to a scaled representation of a time-frequency grid such that the subbands are mapped over time;

computing subband parameters by analyzing each tile of the time-frequency grid using a statistical analysis technique, the subband parameters including one or more of:

(a) F0, which is a frequency offset measured from the bottom of the lowest subband of the first sinusoid;

(b) DeltaF, which is the distance between the two closest sinusoids;

(c) Ph(i), which is the initial phase of each sinusoid, where i=1 . . . N, where N is the total number of sinusoids;

(d) Slant, which is a change in frequency over the time-duration of tile and there is a single subband parameter for all sinusoids in a tile, and the statistical analysis technique is a fast Fourier transform (FFT) technique, further comprising:

performing a fast Fourier transform over samples of the audio signal for each subband to obtain transformed samples; and analyzing the transformed samples to determine whether the pattern for reconstructing the high-frequency components is present;

determining the subband parameters, F0, DeltaF, and Ph(i), for each subband using the transformed samples;

computing a Slant for each F0 and DeltaF to obtain a set of results;

analyzing the set of results to determine a global F0 and a global DeltaF;

finding a pattern in the scaled representation for reconstructing the high-frequency components based on the statistical analysis technique;

encoding the subband parameters and the high-frequency components into an encoded bitstream based on the pattern;

ordering the subband parameters and the high-frequency components in the encoded bitstream such that the subband parameters and the high-frequency components are in order of psychoacoustic importance and subject to the constraint that the subband parameters are placed first in the encoded bitstream followed by the high-frequency components;

transmitting the encoded bitstream over a network channel having a bandwidth; and decoding the encoded bitstream to reconstruct the high-frequency components of the audio signal using the subband parameters in the encoded bitstream.

2. The method of claim 1, further comprising defining low-frequency components as those portions of the audio signal less than approximately 6 kHz and high-frequency components as those portions of the audio signal greater than or equal to approximately 6 kHz.

3. The method of claim 1, further comprising:

determining that the bandwidth of the network channel is unable to accommodate both the subband parameters and the high-frequency components in the encoded bitstream; and transmitting the encoded bitstream containing at least some of the subband parameters and none of the high-frequency components over the network channel.

4. The method of claim 3, further comprising decoding the encoded bitstream to reconstruct the high-frequency components of the audio signal using only the subband parameters in the encoded bitstream.

5. The method of claim 1, further comprising:

filtering the audio signal into time domain samples; and determining the low-frequency components and the high-frequency components of the audio signal using the time domain samples.

6. The method of claim 5, further comprising:

decimating the subband signal outputs to generate decimated subband signal outputs;

normalizing the decimated subband signal outputs to obtain normalized subband signals; and mapping the normalized subband signals to the scaled representation of the time-frequency grid.

7. The method of claim 1, wherein the statistical analysis technique is a direct search technique, further comprising comparing subband parameters measured in each tile of the time-frequency grid to a library of subband parameter patterns to determine whether a pattern exists.

8. The method of claim 7, wherein the library contains patterns of all possible combinations of possible values of subband parameters.

9. The method of claim 7, further comprising:

performing a cross-correlation analysis to find values for Ph(i), the cross-correlation analysis further comprising:

computing a power of subband samples (Pin), a power of synthesized sinusoids (Ps), and their dot product (Prod);

normalizing a cross correlation between the power of subband samples (Pin) and the power of synthesized sinusoids (Ps);

calculating the cross correlation for sinusoids rotated by a rotation angle (Ph(i)); and selecting maximum correlations for sinusoids as the values for the rotation angle (Ph(i)).

10. The method of claim 9, wherein normalizing the cross correlation, Xn, further comprises using the equation:

$$Xn=\mathrm{Prod}/(\mathrm{Sqrt}(\mathrm{Pin})*\mathrm{Sqrt}(Ps)).$$

11. The method of claim 9, further comprising synthesizing the synthesized sinusoids using the equation:

$$S(i,t)=\sin((F0+i*\mathrm{Delta}F)*t+Ph(i))$$

where i is the sinusoid index (0 . . . N), N is the total number of sinusoids, such that frequency (F0+K*DeltaF) is below the highest frequency covered by the tile, and t is the time.

12. The method of claim 11, further comprising:

determining a signal-to-noise ratio (SNR) threshold based on the cross-correlation analysis;

comparing the normalized cross correlation (Xn) to the SNR threshold;

if the normalized cross correlation (Xn) is greater than the SNR threshold, then determining that a pattern is present; and if the normalized cross correlation (Xn) is less than or equal to the SNR threshold, then determining that no pattern is present.

13. The method of claim 12, wherein the SNR threshold is fixed.

14. The method of claim 12, wherein the SNR threshold varies according to a base frequency of a tile in the time-frequency grid.

15. The method of claim 7, further comprising:

performing a difference minimization analysis to find values for Ph(i), the difference minimization analysis further comprising:

computing a power of subband samples (Pin) and a power of a residual signal (Pres) obtained by subtracting synthesized samples from signal samples;

normalizing a difference between the power of subband samples (Pin) and the power of the residual signal (Pres);

calculating the cross correlation for sinusoids rotated by a rotation angle (Ph(i)); and selecting minimum correlations for sinusoids as the values for the rotation angle (Ph(i)).

16. The method of claim 12, wherein normalizing the difference further comprises using the equation:

$$Xn=\mathrm{Prod}/(\mathrm{Sqrt}(\mathrm{Pin})*\mathrm{Sqrt}(Ps)),$$

where Xn is the normalized cross correlation and Prod is a dot product of a power of subband samples (Pin) and a power of synthesized sinusoids (Ps).

17. The method of claim 1, further comprising:

computing an N-point fast Fourier transform (FFT) for each subband of a tile in the time-frequency grid to obtain FFT subband samples;

obtaining an absolute value of FFT amplitude for spectra for the FFT subband samples; and combining the amplitude spectras from the tile subbands into a single spectra by stacking them one after the other to obtain a combined amplitude spectrum.

18. The method of claim 17, wherein stacking them one after the other further comprises:

placing a first subband spectrum into bins 0 to N/2; and placing a second subband spectrum into bins (N/2)+1 to N.

19. The method of claim 17, further comprising:

computing an autocorrelation using the combined amplitude spectrum as an input vector to generate a measured autocorrelation; and determining candidate values of the distance between the two closest sinusoids (DeltaF) by analyzing peaks to find a best fitting DeltaF parameter.

20. The method of claim 19, further comprising:

selecting a value for a candidate DeltaF from the candidate values;

computing a synthesized amplitude spectrum for a synthesized pattern having F0 equal to zero, Slant equal to zero, and DeltaF equal to the candidate value of the candidate DeltaF;

computing a cross correlation between the combined amplitude spectrum and the synthesized amplitude spectrum;

determining a maximum of the cross correlation; and setting the cross-correlation maximum equal as a new value for F0.

21. The method of claim 20, wherein F0 is the new value for F0 and DeltaF is the candidate DeltaF, further comprising:

defining a first half of a tile as all samples from 0 to N/2;

defining a second half of a tile as all samples from (N/2)+1 to N;

repeating the following actions for both the first half and the second half to obtain a first amplitude spectra and a second amplitude spectra;

computing an N-point FFT for each subband of a tile in the time-frequency grid to obtain FFT subband samples;

obtaining an absolute value of FFT amplitude for spectra for the FFT subband samples;

combining the amplitude spectras from the tile subbands into a single spectra by stacking them one after the other to obtain an amplitude spectra;

finding an averaged energy deviation in regions of the first half and the second half that neighbor sinusoid frequencies given as (F0+i*DeltaF);

computing the Slant as a difference between deviations in the first half and the second half.

22. The method of claim 21, further comprising inserting the measured autocorrelation in the encoded bitstream instead of the subband parameters.

23. The method of claim 22, further comprising:

synthesizing a pattern with some fixed values of the F0, DeltaF, and Slant subband parameters to obtain a synthesized fixed pattern; and mixing the synthesized fixed pattern with white noise based on a mix ratio that is proportional to the autocorrelation measure.

24. A method of encoding and decoding an audio signal, comprising:

filtering the audio signal into time-domain samples;

determining low-frequency and high-frequency components of the audio signal;

converting the audio signal into frequency domain;

filtering the audio signal in the frequency domain into a plurality of subbands to produce a plurality of subband signal outputs;

decimating the plurality of subband signal outputs to generate decimated subband signal outputs;

normalizing the decimated subband signal outputs to obtain normalized subband signals;

mapping the normalized subband signals to a scaled representation of a time-frequency grid having a plurality of tiles such that the subbands are mapped over time;

performing a statistical analysis on each tile in the time-frequency grid such that each tile is intersected by at least one subband to compute a measured autocorrelation in each subband in each tile and determine that a pattern exists, computation of the measured autocorrelation further comprising:

computing an N-point fast Fourier transform (FFT) for each subband of a tile in the time-frequency grid to obtain FFT subband samples;

obtaining an absolute value of FFT amplitude for spectra for the FFT subband samples;

combining the amplitude spectras from the tile subbands into a single spectra by stacking them one after the other to obtain a combined amplitude spectrum;

computing an autocorrelation using the combined amplitude spectrum as an input vector to generate the measured autocorrelation;

encoding the measured autocorrelation and high-frequency components into an encoded bitstream in an ordered manner such that the measured autocorrelation is first in the encoded bitstream followed by the high-frequency components;

transmitting the encoded bitstream to a decoder over a network channel having a bandwidth;

decoding the encoded bitstream using the decoder to reconstruct the high-frequency components using the measured autocorrelation;

synthesizing a pattern using the measured autocorrelation and fixed F0, DeltaF, and Slant parameters to obtain a synthesized fixed pattern;

mixing the synthesized fixed pattern with white noise at a mix ratio to obtain reconstructed high-frequency components, the mix ratio being proportional to the measured autocorrelation.

25. The method of claim 24, further comprising:

determining that the bandwidth does not allow both the subband parameters and the high-frequency components to be transmitted over the network channel;

transmitting at least a portion of the subband parameters in the encoded bitstream; and reconstructing the high-frequency components using the transmitted portion of the subband parameters.

26. The method of claim 24, further comprising:

reconstructing the high-frequency components by mixing a synthesized pattern generated from the subband parameters with white noise according to mixing weighting values, the mixing weighting values further comprising:

defining a weighted pattern as:

$$\text{Weighted Pattern}=(\text{Synthesized Pattern})*(0.3+Xn*0.7);$$

defining weight white noise as:

$$\text{Weighed White Noise}=(\text{White Noise})*(0.9f-(Xn*0.7));\text{ and}$$

defining a mixed sample as:

$$\text{Mixed Sample}=\text{Weighted Pattern}+\text{Weighted White Noise};$$

wherein Xn is a normalized cross correlation and f is a frequency.

27. A predictive pattern high-frequency reconstruction system disposed on a scalable bitstream encoder for encoding an audio signal, comprising:

a component determination module for determining low-frequency and high-frequency components of the audio signal;

a subband filter bank for filtering the audio signal into a plurality of subband signal outputs;

a predictive pattern module for determining a pattern in the high-frequency components to allow a decoder to reconstruct the high-frequency components after transmission in an encoded bitstream without including the high-frequency components in the encoded bitstream, the predictive pattern module further comprising:

a normalization module for normalizing the subband signal outputs to produce normalized subband signals;

a mapping module for mapping the normalized subband signals to a time-frequency grid containing multiple tiles representing different frequencies of the audio signal;

a pattern recognition module for performing statistical analysis on each tile to estimate subband parameters for each subband in each tile and determine whether a pattern exists for the high-frequency components, wherein the subband parameters are encoded in an encoded bitstream in an ordered manner such that the subband parameters are placed at the beginning of the encoded bitstream and the high-frequency components are placed after the subband parameters, the subband parameters including a slant parameter that is a change in frequency over a time duration of a tile.

28. A method performed by one or more processing devices for processing an audio signal, comprising:

filtering the low-frequency components and the high-frequency components of the audio signal to produce a plurality of subband signal outputs;

converting the plurality of subband signal outputs to a scaled representation of a time-frequency grid such that the subbands are mapped over time;

computing subband parameters by analyzing each tile of the time-frequency grid using a statistical analysis technique, the subband parameters including Slant, which is a change in frequency over the time-duration of tile;

finding a pattern in the scaled representation for reconstructing the high-frequency components based on the statistical analysis technique;

encoding the subband parameters and the high-frequency components into an encoded bitstream based on the pattern;

ordering the subband parameters and the high-frequency components in the encoded bitstream such that the subband parameters and the high-frequency components are in order of psychoacoustic importance and subject to the constraint that the subband parameters are placed first in the encoded bitstream followed by the high-frequency components;

transmitting the encoded bitstream over a network channel having a bandwidth; and decoding the encoded bitstream to reconstruct the high-frequency components of the audio signal using the subband parameters in the encoded bitstream.

* * * * *